US007878764B2

(12) United States Patent
Dakhoul

(10) Patent No.: US 7,878,764 B2
(45) Date of Patent: Feb. 1, 2011

(54) ADJUSTABLE FAN AND METHOD

(75) Inventor: Youssef M. Dakhoul, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 822 days.

(21) Appl. No.: 11/880,530

(22) Filed: Jul. 23, 2007

(65) Prior Publication Data

US 2009/0028709 A1 Jan. 29, 2009

(51) Int. Cl.
*F04D 29/36* (2006.01)

(52) U.S. Cl. ..... 416/208; 416/214 R; 416/220 A

(58) Field of Classification Search ..... 416/205, 416/207, 208, 220 A, 248, 214 R, 214 A, 416/153, 147, 129, 220 R, 209
See application file for complete search history.

(56) References Cited

U.S. PATENT DOCUMENTS 1,869,182 A 7/1932 Blanchard
2,307,490 A 1/1943 Curley
3,545,884 A 12/1970 Schroeter et al.
3,687,569 A 8/1972 Klompas
3,924,404 A 12/1975 Pollert
5,354,176 A 10/1994 Schilling et al.
6,431,835 B1 8/2002 Kolodziej et al.
6,692,231 B1 2/2004 Calvert

FOREIGN PATENT DOCUMENTS

JP 59208200 A * 11/1984
JP 03286200 A * 12/1991

OTHER PUBLICATIONS

PTO 2010-3676. English translation of JP H03-286200. pp. 1-7. May 28, 2010.*

* cited by examiner

*Primary Examiner*—Richard Edgar
(74) *Attorney, Agent, or Firm*—Richard K. Chang

(57) ABSTRACT

An adjustable fan includes a hub having a receiving surface and a fan blade having a base abutting the receiving surface of the hub. A plurality of keyways may be positioned in at least one of the receiving surface and the base. A key may extend between the base and the receiving surface and into at least one of the plurality of keyways in order to retain the fan blade in a desired orientation relative to the hub.

23 Claims, 3 Drawing Sheets

ADJUSTABLE FAN AND METHOD

TECHNICAL FIELD

This invention relates generally to an adjustable fan and method for adjusting the orientation of a blade of the fan.

BACKGROUND

Many different factors may be considered when a fan is selected for use with a cooling system of a machine. For example, efficiency, noise and size configurations may be very important factors when selecting the configuration of a fan. Thus, different machines and operating environments may require different fan configurations.

Generally, fans may be made through a wide variety of molding processes that form the blades and hub as a single piece. Consequently, each different configuration of a fan may require its own mold. Additionally, each mold may be a very costly tool and stocking multiple fans may require significant warehouse space. Further, all of these costs and different fan configurations may affect part availability and the logistical costs of supporting a wide variety of different fan configuration.

To provide some adjustability, U.S. Pat. No. 3,545,884 discloses an adjustable fan blade construction where each blade is bolted through a hub to a back plate. The fan blades of the '884 patent can be easily rotated to a desired orientation and rely on centrifugal forces and friction to maintain the desired orientation. Consequently, the blades of the '884 patent may be inadvertently reoriented to an undesirable orientation when a force, such as flying debris, is applied to a fan blade that overcomes the centrifugal forces and friction.

The present invention is directed to overcome one or more of the problems as set forth above.

SUMMARY OF THE INVENTION

In one example of the present invention, an adjustable fan is provided. The fan may include a hub having a receiving surface and a fan blade having a base abutting the receiving surface of the hub. A plurality of keyways may be positioned in at least one of the receiving surface and the base and a key extending between the base and the receiving surface and into at least one of the plurality of keyways to maintain the fan blade in a first orientation.

In some configurations, the base of the fan blade may have a circular cross section. Additionally, the hub may include a first part and a second part. The first part may include the receiving surface and may be shaped to abut the base of the fan blade.

To adjust the adjustable fan, a fan blade angle relative to the hub may be selected. Then, the key may be placed into one of a plurality of keyways that corresponds to the fan blade angle to maintain the fan blade in the desired fan blade angle.

DETAILED DESCRIPTION

Figure 1:
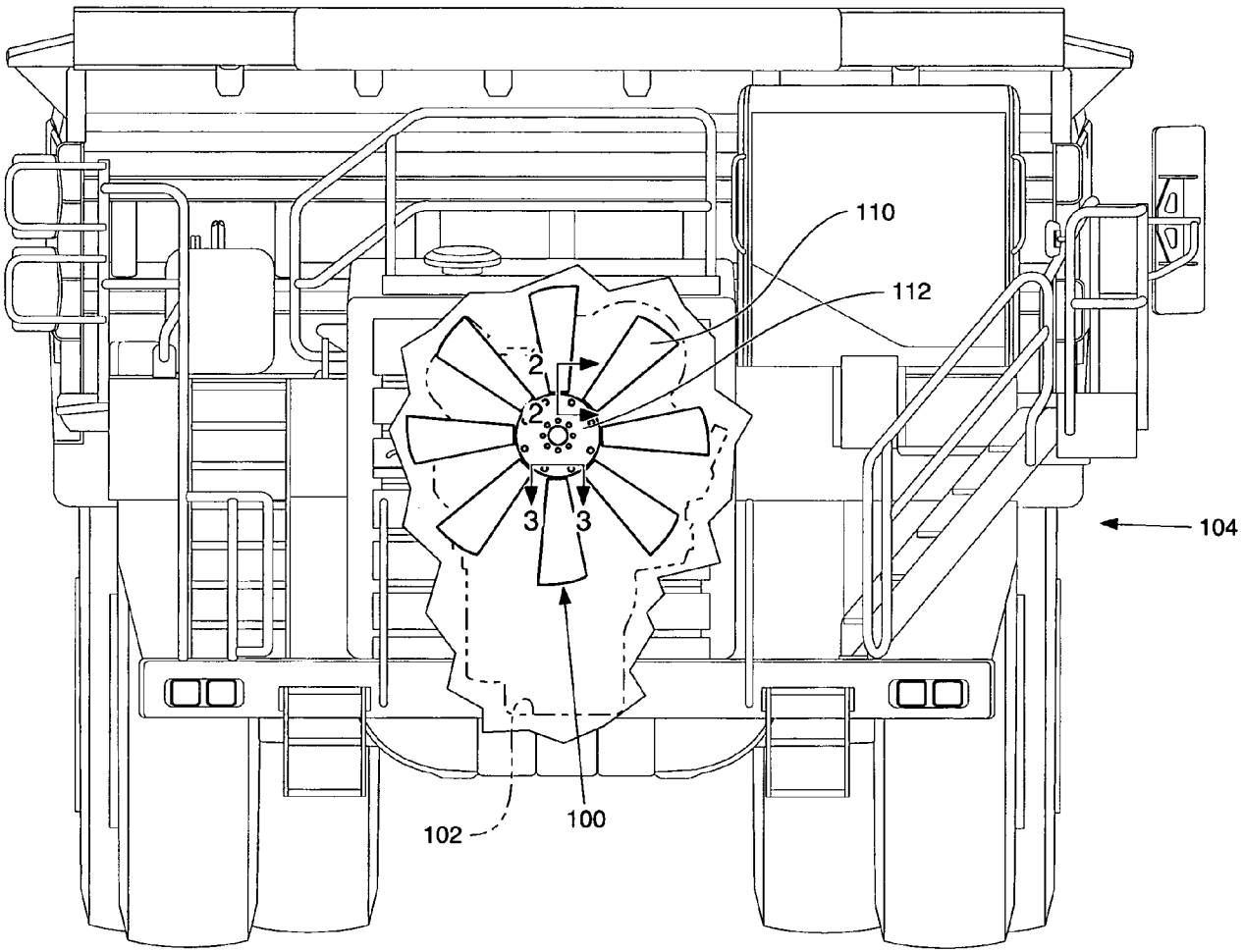
FIG. 1 is a perspective view of an adjustable fan connected to an engine shown in phantom.

Referring to FIG. 1, a perspective view illustrates an adjustable fan 100 connected to an engine 102 of a machine 104 shown in phantom. The adjustability of the fan 100 permits it to be used with a variety of engine 102 sizes and types while minimizing logistical supply costs. Specifically, an angle of each fan blade 110 relative to a hub 112 can be adjusted. In some configurations, the angle may be adjusted to provide maximum performance of the fan 100 where noise caused by the rotation of the fan 100 during use may be less of a concern or adjusted to minimize noise while providing desirable performance.

Additionally, the fan 100 may be used with a variety of machines 104 to increase the cooling capacity of machine 104 cooling systems. As shown, the machine 104 may be a large off-highway truck. Alternatively, the machine 104 may be a track-type tractor, wheel loader, excavator, on-highway truck, or any other machine that uses an engine 102.

Figure 2:
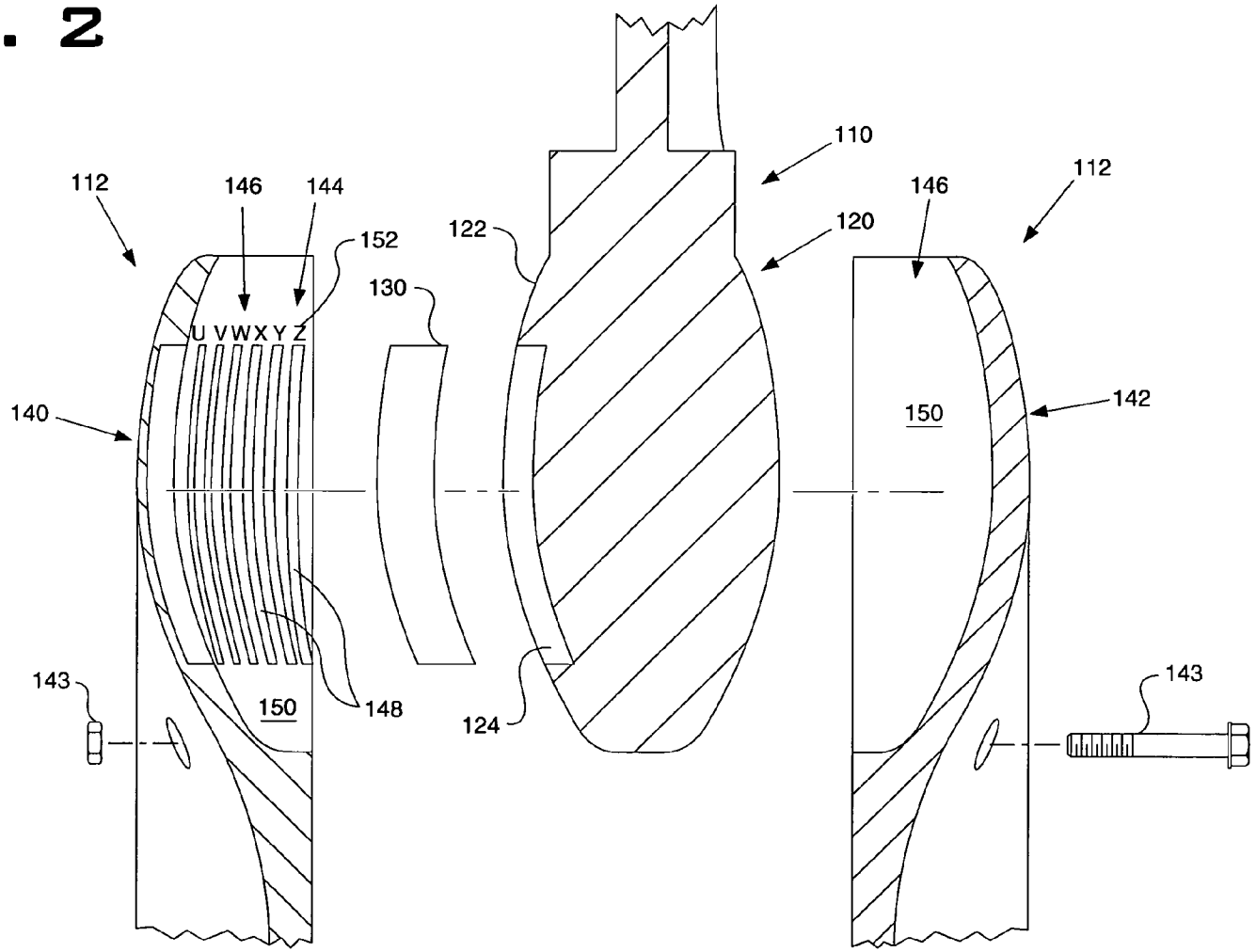
FIG. 2 is an exploded cross section view of the adjustable fan of FIG. 1 along lines 2-2.

Referring to FIG. 2 is an exploded cross section view of the fan 100 of FIG. 1 along lines 2-2. As shown, the fan 100 may include a fan blade 110. The fan blade 110 may include a base 120 shaped for connection to the hub 112.

The base 120 may include a shoulder 122 for engaging the hub 112 and may include one or more keyways 124. The keyways 124 are shaped to receive a key 130 that prevents the fan blade 110 from rotating and changing orientation relative to the hub 112. In other words, the key 130 retains the fan blade 110 in a desired orientation relative to the hub 112 and the hub 112 engages the shoulder 122 to prevent the fan blade 110 from being disconnected from the hub 110.

The fan blade 110 may be made of metal, plastic, or composite and may be manufactured by molding, casting, machining, and other manufacturing methods known in the art. Similarly, the key 130 may be made of metal, plastic, or composite, and shaped to extend into one of the keyways 124 of the base 120 while also extending into the hub 112 to retain the fan blade 110 in a first orientation relative to the hub 112.

The hub 112 may include a first part 140 and a second part 142 that cooperate to secure each fan blade 110 to the hub 112 at an attachment point 144 by surrounding the base 120 and engaging the shoulder 122. The first and second parts 140, 142 of the hub 112 may be connected by mechanical fasteners such as nuts and bolts 143. Alternatively, the first and second parts 140, 142 of the hub 112 may be connected by integrally formed fasteners, such as threaded shafts or clips (not shown).

Each attachment point 144 may include a receiving surface 146 against which the base 120 abuts to prevent disconnection of the fan blade 110 from the hub 112. Specifically, the receiving surface 146 may be shaped to engage the shoulder 122 of the base 120 to prevent the fan blade 110 from pulling out of the hub 112 when the fan 100 is in use.

Each receiving surface 146 may include one or more keyways 148 for receiving a portion of the key 130 to retain the fan blade 110 in a first orientation. As shown, a plurality of keyways 124, 148 may be positioned in at least one of the receiving surface 146 and the base 120 to provide adjustable positioning of the fan blade 110 relative to the 120, by changing the location of the key 130 in the plurality of keyways 124, 148. Additionally, the receiving surface 146 may include areas 150 without a keyway 148.

Alternatively in some configurations, the key 130 may be integrally formed with one of the base 120 or the receiving surface 146. Consequently, the key 130 may be placed in one of a plurality of keyways 124, 148 in the other of the base 120 and the receiving surface 146. Additionally, as may be recognized by one of skill in the art, the keyways 124, 148 may have any cross sectional shape such as a polygonal, irregular, or circular shape.

As shown, each keyway 124, 148 may be marked with an indicator 152 to facilitate the orientation of all the fan blades 110 with respect to the hub 112 and to prevent one or more of a plurality of fan blades 110 from being misaligned.

Figure 3:
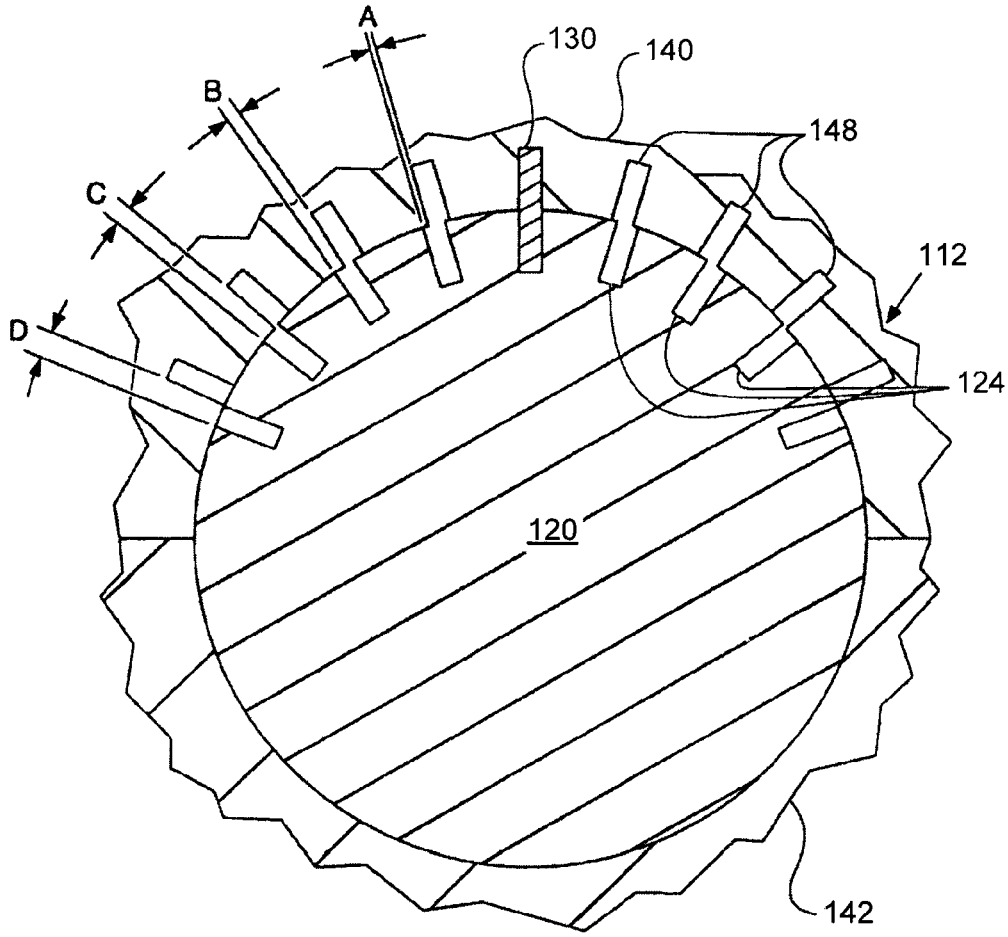
FIG. 3 is a cross section view of the adjustable fan of FIG. 1 along lines 3-3.

FIG. 3 is a cross section view of the adjustable fan 100 of FIG. 1 along lines 3-3. As shown, the receiving surface 146 may be curved and follow a circular contour. Likewise, the base 120 may have a circular cross section to facilitate adjustment of a fan blade angle. Additionally, the plurality of keyways 124, 148 may include an equal number of keyways 124, 148 positioned in the receiving surface 146 and the base 120.

In some configurations, the plurality of keyways 124, 148 may be equally or unequally spaced along the receiving surface 146 and the base 120. For example, the plurality of keyways 124, 148 may be unequally spaced to provide specific fan blade angles that have been optimized for specific applications.

In configurations where the plurality of keyways 124, 148 are equally spaced on a respective base 120 and receiving surface 146, the keyways 124 on the base 120 may have a different spacing than the plurality of keyways 148 on the receiving surface 146. For example, the keyways 124 on the base 120 may be spaced about one degree more than the plurality of keyways 148 on the receiving surface 146, so that as the key 130 is moved to different keyways 124, 148, the orientation of the fan blade 110 can be adjusted in one degree increments.

As shown, the fan blade 110 can be adjusted forward or backward by A, B, C, or D degrees with A, B, C, and D being previously selected. In some configurations, the keyways 124, 148 may be disposed for particular settings such as A provides the most efficient air flow for a first engine configuration while B provides the most efficient air flow for a second engine configuration. Conversely, C and D may provide the quietest operation for the first and second engine configurations respectively. In other words, one of the keyways 124 in the base 120 and one of the keyways 148 in the receiving surface 146 may dispose the fan blade 110 at an angle that provides maximum energy efficiency, minimum noise, or some other desired performance.

By controlling the offset, very small adjustments in fan blade angle may be achieved. Additionally, where greater adjustments are desired, the key 130 may be retained in one of the keyways 124, 148 and the other keyway 124, 148 changed. Of course, fan blade angle consistency is dependent on the tolerance and process controls that may be achieved during the formation of the keyways 124, 148.

Once the fan blade 110 has been oriented in a desired orientation and adjustment is no longer desired, an adhesive (not shown) may be used to attach the key 130 to one or both of the keyways 124, 148. Alternatively, the key 130 may be integrally formed with the base 120 of the fan blade 110 as a unitary body. In an alternative configuration, the key 130 may also be integrally formed on a receiving surface 146 of the hub 112.

INDUSTRIAL APPLICABILITY

The fan 100 may be adjusted in order to maximize efficiency or minimize noise or to meet specific application requirements. To adjust the fan 100, a fan blade angle relative to the hub 112 may be selected. Then, the first part 140 of the hub 112 may be separated from the second part 142 of the hub 112 in order to remove the base 120 of the fan blade 110 from the receiving surface 146. Additionally, the key 130 may be separated from the keyways 124, 148 of the base 120 and the receiving surface 146. These steps may be repeated with some or all of the fan blades 110 of the fan 100.

Next, with the fan blades 110 that have had their keys 130 removed, each key 130 may be placed into one of the plurality of keyways 124 of the base 120 and into one of the keyways 148 of the receiving surface 146 of the respective attachment point 144 that correspond to the fan blade angle. In some configurations, an adhesive may be applied to permanently secure the fan blade 110 in a desired orientation relative to the hub 112. Additionally, the base 120 of the fan blade 110 may be abutted against the receiving surface 146.

Once all of the fan blades 110 of the fan 100 have been adjusted to the selected fan blade angle, the first part 140 of the hub 112 may be connected to the second part 142 of the hub 112. More specifically, the first part 140 may be bolted to the second part 142.

It will be apparent to those skilled in the art that various modifications and variations can be made without departing from the scope or spirit of the invention. Additionally, other embodiments of the invention will be apparent to those skilled in the art from consideration of the specification and practice of the invention disclosed herein. It is intended that the specification and examples be considered as exemplary only.

What is claimed is:

1. An adjustable fan comprising:
a hub including a receiving surface;
a fan blade having a base abutting the receiving surface of the hub, wherein the base has a convexly curved outer surface in a radial cross section of the base, and the receiving surface of the hub has a mating concavely curved surface;
a plurality of keyways positioned in at least one of the receiving surface or the base; and
a key extending between the base and the receiving surface and into at least one of the plurality of keyways.

2. The adjustable fan of claim 1, wherein a first subset of the plurality of keyways are about equally spaced along one of the receiving surface and the base.

3. The adjustable fan of claim 2, wherein a second subset of the plurality of keyways is about equally spaced along the other of the receiving surface and the base.

4. The adjustable fan of claim 3, wherein the first subset of the plurality of keyways has a different spacing than the second subset of the plurality of keyways.

5. The adjustable fan of claim 4, wherein the first subset of the plurality of keyways is spaced about one degree more than the second subset between each of the plurality of keyways.

6. The adjustable fan of claim 4, wherein the key extends into one of the first subset of the plurality of keyways and one of the second subset of the plurality of keyways.

7. The adjustable fan of claim 1, wherein the key is integrally formed with one of the receiving surface and the base as a unitary body.

8. The adjustable fan of claim 1, wherein the hub includes a first half and a second half, wherein the first and second halves of the hub cooperate to define the receiving surface.

9. The adjustable fan of claim 1, wherein the plurality of keyways include an equal number of keyways positioned in the receiving surface and the base.

10. The adjustable fan of claim 1, wherein one or more of the plurality of keyways is disposed in at least one of the convexly curved outer surface or the mating concavely curved surface.

11. The adjustable fan of claim 1, wherein one or more of the plurality of keyways has a curved shape in radial cross section and is disposed in at least one of the convexly curved outer surface or the mating concavely curved surface.

12. An adjustable fan comprising:

a fan blade having a base, the base having a circular cross section in a direction perpendicular to radial, the base also having a convexly curved outer surface in a radial cross section;

a hub including a first piece and a second piece, the first piece including a concavely curved receiving surface shaped to abut the convexly curved outer surface of the base of the fan blade, the receiving surface including a plurality of keyways; and a key extending into one of the plurality of keyways to maintain the fan blade in a first orientation.

13. The adjustable fan of claim 12, wherein the plurality of keyways are equally spaced along the receiving surface.

14. The adjustable fan of claim 12, wherein the base includes a second plurality of keyways.

15. The adjustable fan of claim 14, wherein the second plurality of keyways has a different spacing than the plurality of keyways of the receiving surface.

16. The adjustable fan of claim 14, wherein the key extends into one of the plurality of keyways of the receiving surface and one of the second plurality of keyways.

17. The adjustable fan of claim 12, wherein one or more of the plurality of keyways is disposed in at least one of the convexly curved outer surface of the base or the concavely curved receiving surface of the first piece.

18. A method of adjusting an adjustable fan, the method comprising:

selecting a fan blade angle for a fan blade relative to a hub, the hub including a first piece and a second piece;

placing a key into one of a plurality of keyways that corresponds to the fan blade angle, wherein the plurality of keyways are disposed in one of a receiving surface of the hub or a base of the fan blade;

abutting an outer surface of the base of the fan blade against the receiving surface, wherein the outer surface of the base of the fan blade has a convexly curved shape in a radial cross section, and the receiving surface has a mating concavely curved shape; and connecting the first piece of the hub to the second piece of the hub.

19. The method of claim 18, further comprising the steps of:

separating the first part of the hub from the second part of the hub, wherein the first part includes the receiving surface; and removing the base of the fan blade from the receiving surface.

20. The method of claim 18, wherein the other of the base and the receiving surface includes a second plurality of keyways, the method further comprising the step of placing the key into one of the second plurality of keyways that corresponds to the fan blade angle.

21. The method of claim 18, wherein the key is integrally formed with the base as a unitary body.

22. The method of claim 18, wherein the base has a circular cross section.

23. The method of claim 18, wherein one or more of the plurality of keyways is disposed in at least one of the convexly curved outer surface of the base or the mating concavely curved receiving surface.

* * * * *